US009369802B2

(12) United States Patent
Akino

(10) Patent No.: US 9,369,802 B2
(45) Date of Patent: Jun. 14, 2016

(54) STEREO MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 42 days.

(21) Appl. No.: 14/289,993

(22) Filed: May 29, 2014

(65) Prior Publication Data

US 2014/0369507 A1 Dec. 18, 2014

(30) Foreign Application Priority Data

Jun. 17, 2013 (JP) ..... 2013-126392
Feb. 25, 2014 (JP) ..... 2014-33899

(51) Int. Cl.
*H04R 5/027* (2006.01)

(52) U.S. Cl.
CPC ..... *H04R 5/027* (2013.01)

(58) Field of Classification Search
CPC ..... H04R 5/00; H04R 5/27; H04R 3/005; H04R 9/16; H04R 9/14; H04R 11/12; H04R 11/10; H04R 17/08; H04R 17/06; H04R 19/10; H04R 19/08; H04S 3/00; H04S 1/00; H04S 1/0024; H04S 7/40
USPC ..... 381/26, 122, 355, 176
See application file for complete search history.

(56) References Cited

U.S. PATENT DOCUMENTS

2004/0125975 A1* 7/2004 Suzuki ..... H04R 1/38 381/369
2006/0222187 A1* 10/2006 Jarrett ..... H04R 3/002 381/92
2011/0188680 A1* 8/2011 Akino ..... H04R 6/048 381/176
2011/0194703 A1* 8/2011 Akino ..... H04R 3/04 381/26

FOREIGN PATENT DOCUMENTS

JP 2006-174136 6/2006

* cited by examiner

*Primary Examiner* — Paul S Kim
*Assistant Examiner* — Sabrina Diaz
(74) *Attorney, Agent, or Firm* — Whitham, Curtis & Cook, P.C.

(57) ABSTRACT

A stereo microphone includes two unidirective mid units and a bidirective side unit, the side unit is a ribbon microphone unit including a ribbon diaphragm, the two mid units are disposed at two respective surfaces of the ribbon diaphragm of the side unit, and the mid units each have a sound collecting axis along a longitudinal direction of the ribbon diaphragm in the side unit.

9 Claims, 4 Drawing Sheets

STEREO MICROPHONE

TECHNICAL FIELD

The present invention relates to a mid-side (MS) stereo microphone without misalignment of its directive axis even in a high frequency range.

BACKGROUND ART

Various types stereo microphones are known such as an MS stereo microphone adding and subtracting side (S) signals to and from mid (M) signals to acquire left (L) and right (R) signals, respectively (see Japanese Unexamined Patent Application Publication No. 2006-174136).

In other words, the L signal corresponds to the sum of the S signal and the M signal, while the R signal corresponds to the subtraction of S signal from the M signal. A microphone unit detecting M signals is composed of a unidirective unit. A microphone unit detecting S signals is composed of a bidirective unit.

The unidirective and bidirective units each having a predetermined size have respective diaphragms and thus different directive axes. The unidirective and bidirective units are disposed vertically or horizontally (front-back direction) to constitute the MS stereo microphone. The respective directive axes of the unidirective and bidirective units are therefore disposed at different vertical or horizontal positions depending on the placement of the units. In such a conventional stereo microphone, the mid unit detecting M signals and the side unit detecting S signals have different directive axes. In other words, the conventional MS stereo microphone includes the mid unit having a different effective acoustic center from that of the side unit.

An increase in such a difference in the positions of the directive axes or in the effective acoustic centers causes misalignment from the original direction of sound pickup axis for detecting sound waves. In particular, short wavelength, i.e., high frequency signals involve this phenomenon remarkably.

Additionally, in the conventional MS stereo microphone, the right and left directive angles is not variable separately.

SUMMARY OF INVENTION

Technical Problem

It is therefore an object of the present invention to provide an MS stereo microphone without misalignment of its directive axis even in a high frequency range.

Solution to Problem

According to an aspect of the present invention, a stereo microphone includes two unidirective mid units and a bidirective side unit, the bidirective side unit is a ribbon microphone unit including a ribbon diaphragm, the two unidirective mid units are disposed at two respective surfaces of the ribbon diaphragm of the bidirective side unit, and the two unidirective mid units each have a sound pickup axis along the longitudinal direction of the ribbon diaphragm in the bidirective side unit.

Advantageous Effects of Invention

The present invention can provide an MS stereo microphone without misalignment of its directive axis even in a high frequency range.

DESCRIPTION OF EMBODIMENT

Figure 1:
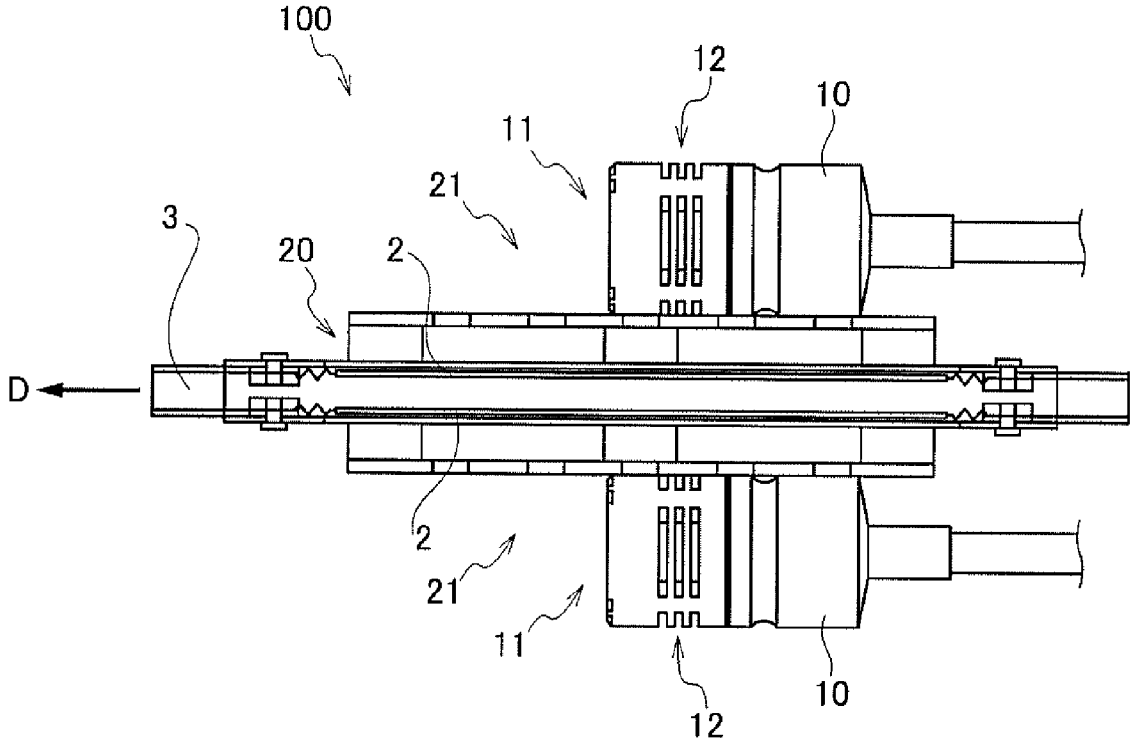
FIG. 1 is a side view illustrating a stereo microphone according to an embodiment of the present invention.

A stereo microphone in an embodiment of the present invention will now be described with reference to the accompanying drawings. FIG. 1 is a side view illustrating a stereo microphone 100 according to the present embodiment. In FIG. 1, the stereo microphone 100 includes two unidirective microphone units 10 and a ribbon microphone unit 20. As illustrated in FIG. 1, the stereo microphone 100 has a directive axis along a sound pickup direction D.

In the stereo microphone 100 that is of a mid-side (MS) type, the unidirective microphone unit 10 is a mid unit detecting mid (M) signals, and the ribbon microphone unit 20 is a side unit detecting side (S) signals.

Figure 3:
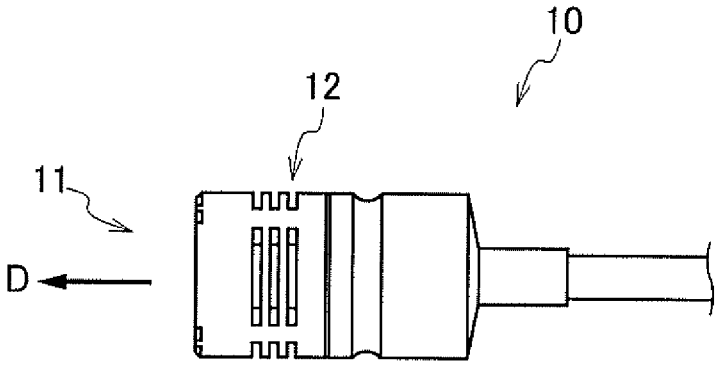
FIG. 3 is a side view illustrating an example unidirective unit of the stereo microphone.

The unidirective microphone unit 10 and the ribbon microphone unit 20 will now be described. FIG. 3 is an external view of the unidirective microphone unit 10. In FIG. 3, the unidirective microphone unit 10 has a front acoustic terminal 11 oriented in the sound collecting direction D. The unidirective microphone unit 10 has a rear acoustic terminal 12 oriented in a direction orthogonal to the sound collecting direction D.

Figure 4A:
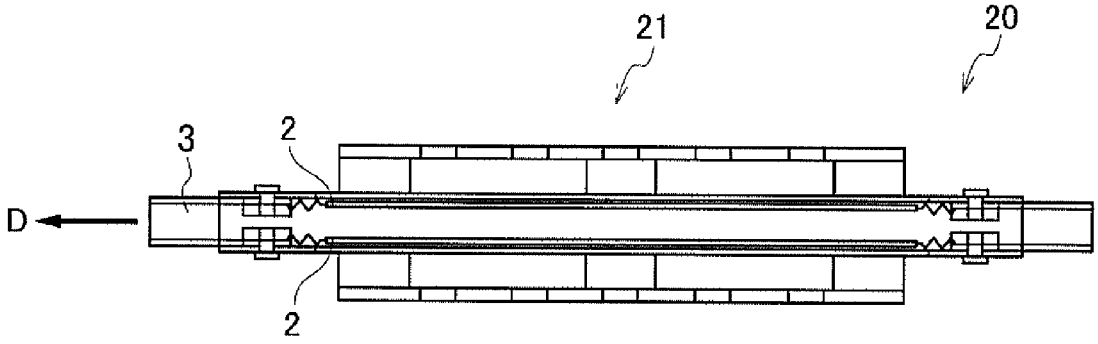
FIG. 4A is a side view illustrating an example bidirective unit of the stereo microphone.
Figure 4B:
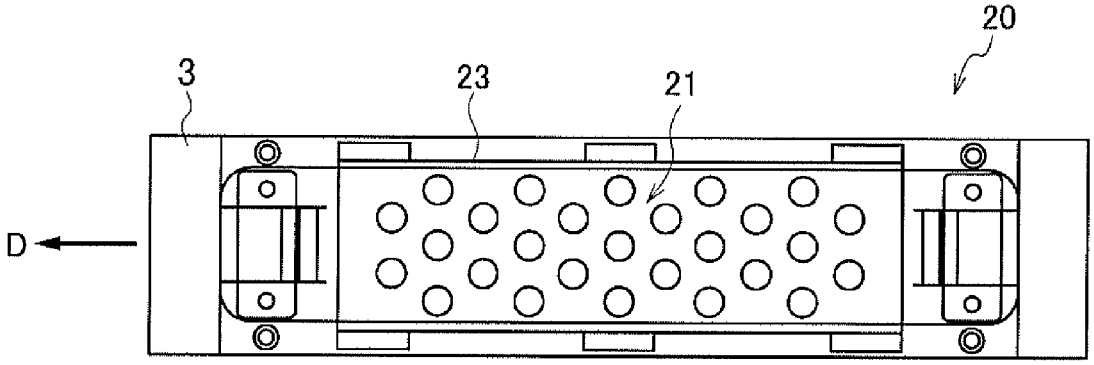
FIG. 4B is a plane view of the bidirective unit.

FIGS. 4A and 4B are an external side view and an external plane view, respectively, of the ribbon microphone unit 20. As illustrated in FIG. 4A and FIG. 4B, the ribbon microphone unit 20 includes a frame 3 as a main component. The rectangular frame 3 has quadrangular prismatic permanent magnets (not illustrated) fixed on the respective inner surfaces facing each other in its longitudinal direction. The facing permanent magnets generate a magnetic field therebetween, and two ribbon diaphragms 2 are disposed in the magnetic field. The two ribbon diaphragms 2 parallel to each other at an appropriate distance. Each diaphragm has two longitudinal ends supported by the frame 3, and the two ends are electrically-insulated from the frame 3. The two ribbon diaphragms 2 independently vibrate in response to sound waves. The two ribbon diaphragms 2 intersect the magnetic flux of the magnetic field due to the vibration, and then generate electrical signals in response to the sound waves. After such electro-acoustic conversion in the ribbon microphone unit 20, the audio signals converted by each of the two ribbon diaphragms 2 are outputted from two longitudinal ends of the ribbon diaphragm 2.

As illustrated in FIG. 4A, the ribbon microphone unit 20 includes the two ribbon diaphragms 2 vertically disposed in a side view. The ribbon diaphragms 2 independently pick up sounds. In other words, audio signals pick up by the ribbon microphone unit 20 are composed of two S signal components. As illustrated in FIG. 4B, the two ribbon diaphragms 2 are protected by respective protective plates 23 disposed at the frame 3. Each protective plate 23 is disposed at the frame 3 at an appropriate distance from the surface of the ribbon diaphragm 2. The protective plate 23 has multiple holes. Sound waves pass through the holes to vibrate the ribbon diaphragm 2. As a result, the ribbon microphone unit 20 has an acoustic terminal 21 provided in the longitudinal direction of each ribbon diaphragm 2. This configuration enables the ribbon microphone 20 to serves as a bidirective unit.

The two mid units are each composed of the unidirective microphone. The side unit is composed of the ribbon microphone. The unidirective microphone units 10 are disposed at the outer surfaces of the respective ribbon diaphragms 2 in the ribbon microphone unit 20 (side unit). In the illustrated embodiment, the ribbon microphone unit 20 includes the two ribbon diaphragms 2. Each ribbon diaphragm 2 has an outer surface serving as the acoustic terminal 21. The ribbon microphone unit 20 therefore includes the two acoustic terminals 21. The two acoustic terminals 21 serve as front and rear acoustic terminals 21 for the ribbon microphone unit 20. The unidirective microphone units 10 (mid units) are mounted on the front and rear acoustic terminals 21, respectively, of the ribbon microphone unit 20 (side unit). More specifically, the two mid units are mounted symmetrically on two sides of the side unit.

Figure 2:
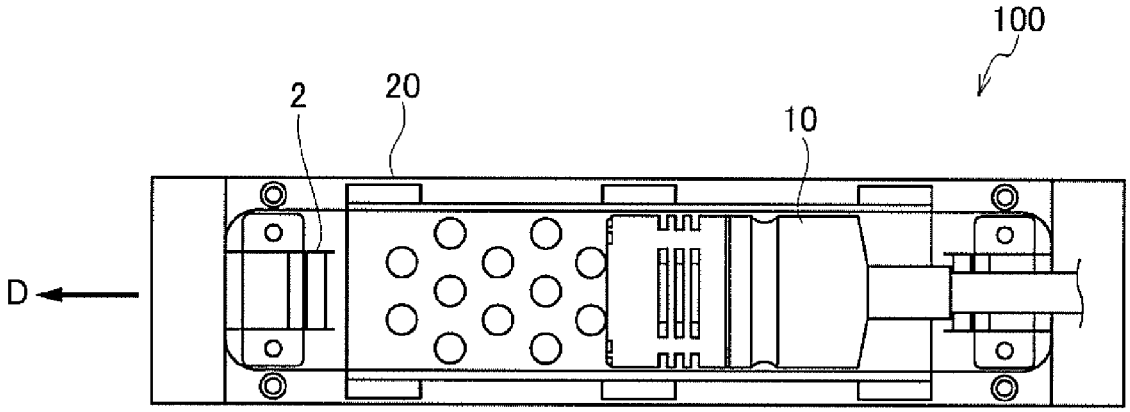
FIG. 2 is a plane view of the stereo microphone.

FIG. 2 is a plane view of the stereo microphone 100. The stereo microphone 100 in FIG. 2 has a sound pickup direction D oriented toward one longitudinal end of the ribbon diaphragm 2 in the ribbon microphone unit 20. The unidirective microphone unit 10 is a mid unit detecting M signals. The unidirective microphone unit 10 has a directive axis (sound pickup axis) along the longitudinal direction of the ribbon diaphragm 2. More specifically, the unidirective microphone unit 10 is disposed along an approximate half of the length of the ribbon microphone unit 20.

The two mid units in the illustrated embodiment are unidirective condenser microphone units, which each include the front and rear acoustic terminals 11 and 12. The respective unidirective microphone units 10 are disposed at the acoustic terminals 21 of the ribbon microphone unit 20 such that the front acoustic terminals 11 of the two mid units are located in the longitudinal center of the acoustic terminal 21 in the ribbon microphone unit 20.

One of the two ribbon diaphragms 2 outputs bidirective audio signals (S). One of the mid units outputs unidirective audio signals (M). For example, the audio signals (S) are subtracted from the audio signals (M) to output audio signals (R) having a directive axis shifted to the right. The audio signals (S) outputted from the other of the two ribbon diaphragms 2 are added to the audio signals (M) outputted from the other of the mid units to output audio signals (L) having a directive axis shifted to the left. This procedure can acquire stereo signals having directive axes separated into right and left.

The audio signals to be outputted may be combined in any other appropriate manner. For example, the audio signals (S) may be subtracted from and added to the audio signals (M) to output audio signals (L) and (R), respectively. The unidirective microphone unit 10 may be fixed to the ribbon microphone unit 20 in any appropriate manner, for example, with a double-sided adhesive tape or a binding material.

The stereo microphone 100 described above includes the front and rear acoustic terminals 11 and 12 arranged in the unidirective microphone unit 10 disposed at the respective acoustic terminals 21 of the ribbon microphone unit 20 serving as a bidirective unit. That is, the acoustic terminals of the unidirective units and the respective acoustic terminals of the bidirective unit are disposed at the same acoustic position. This configuration enables the ribbon diaphragm 2 of the ribbon microphone unit 20 and the diaphragm (not illustrated) of each unidirective microphone unit 10 to be driven by the same audio waves. As a result, the directive axis of the stereo microphone 100 is not misaligned even for collection of short wavelength, i.e., high frequency sounds.

The present invention may also be applied to a ribbon microphone unit 20 having only one ribbon diaphragm 2 used for the stereo microphone. Even one ribbon diaphragm 2 can also provide bidirectivity. The bidirective signals may be subtracted from and added to the unidirective audio signals (M). This configuration can provide the same advantageous effects as those of the stated embodiment.

The ribbon microphone unit 20 detecting S signals in the illustrated embodiment more preferably includes an adjustment unit that can separately adjust the respective output levels of the front and rear ribbon diaphragms 2. This configuration can separately adjust the levels of bidirective audio signals outputted from the two ribbon diaphragms 2. Thus, the composite ratio of the M signal to right or left S signal can be independently varied at the right and left. As a result, the angles of the right and left directive axes are separately adjusted.

In the stereo microphone 100, the unidirective microphone unit operative for M signals is most preferably composed of a unidirective condenser microphone unit. A compact condenser microphone unit contributes to a reduction in size of the stereo microphone 100.

What is claimed is:

1. A stereo microphone comprising two unidirective mid units and a bidirective side unit, wherein the bidirective side unit is a ribbon microphone unit including a ribbon diaphragm;

the two unidirective mid units are disposed at two respective surfaces of the ribbon diaphragm of the bidirective side unit; and the two unidirective mid units each have directive axis along a longitudinal axis of the ribbon diaphragm in the bidirective side unit, and the directive axes of the two unidirective mid units are both facing in the same direction along the longitudinal axis of the ribbon diaphragm.

2. The stereo microphone according to claim 1, wherein the two unidirective mid units are mounted on acoustic terminals of the bidirective side unit.

3. The stereo microphone according to claim 2, wherein the two unidirective mid units are mounted symmetrically on two sides of the bidirective side unit.

4. The stereo microphone according to claim 1, wherein the two unidirective mid units are condenser microphone units each including front and rear acoustic terminals.

5. The stereo microphone according to claim 4, wherein the bidirective side unit includes two acoustic terminals, and the respective front acoustic terminals of the two unidirective mid units are located in the longitudinal center of a correspondent acoustic terminal of the bidirective side unit.

6. The stereo microphone according to claim 1, wherein the bidirective side unit includes two ribbon diaphragms for each outputting bidirective audio signals.

7. The stereo microphone according to claim 6, wherein the bidirective audio signals outputted from one and the other of the two ribbon diaphragms are subtracted from and added to the audio signals outputted from one and the other of the two unidirective mid units to acquire stereo signals having directive axes separated into right and left, respectively.

8. The stereo microphone according to claim 7, wherein the respective levels of the bidirective audio signals outputted from one and the other of the two ribbon diaphragms can separately be adjusted to separately adjust the respective angles of the right and left directive axes.

9. The stereo microphone according to claim 2, wherein the two unidirective mid units are condenser microphone units each including front and rear acoustic terminals, and the respective front acoustic terminals of the two unidirective mid units are located in a longitudinal center of a correspondent acoustic terminal of the bidirective side unit.

* * * * *